US008184089B2

(12) United States Patent
Botzas et al.

(10) Patent No.: US 8,184,089 B2
(45) Date of Patent: May 22, 2012

(54) BACKLIGHT LEVEL SELECTION FOR DISPLAY DEVICES

(75) Inventors: Anthony Botzas, San Jose, CA (US); Sarah Sunyoung Hwang, Sunnyvale, CA (US)

(73) Assignee: Samsung Electronics Co., Ltd. (KR)

( * ) Notice: Subject to any disclaimer, the term of this patent is extended or adjusted under 35 U.S.C. 154(b) by 332 days.

(21) Appl. No.: 12/511,906

(22) Filed: Jul. 29, 2009

(65) Prior Publication Data

US 2011/0025592 A1 Feb. 3, 2011

(51) Int. Cl.
*G09G 3/36* (2006.01)

(52) U.S. Cl. ..... 345/102; 345/89; 345/690

(58) Field of Classification Search ..... 345/102, 345/589, 590, 591, 596, 604, 614, 619, 690, 345/89

See application file for complete search history.

(56) References Cited

U.S. PATENT DOCUMENTS 5,703,644 A * 12/1997 Mori et al. ..... 348/363
7,136,044 B2 * 11/2006 Sasaki ..... 345/102
7,173,599 B2 * 2/2007 Nishimura ..... 345/102
7,403,231 B2 * 7/2008 Kawanishi ..... 348/364
7,406,193 B2 * 7/2008 Watanabe ..... 382/168
7,924,254 B2 * 4/2011 Hsu et al. ..... 345/89
2006/0274026 A1 * 12/2006 Kerofsky ..... 345/102
2009/0160877 A1 * 6/2009 Peng et al. ..... 345/690
2009/0167673 A1 * 7/2009 Kerofsky ..... 345/102
2009/0284546 A1 * 11/2009 Brown Elliott ..... 345/596

* cited by examiner

*Primary Examiner* — Kimnhung Nguyen

(74) *Attorney, Agent, or Firm* — Innovation Counsel LLP

(57) ABSTRACT

Display systems and methods for adjusting backlight illumination are disclosed for selecting a backlight illumination level that is low enough to reduce backlight power consumption while maintaining a desired level of image quality. The method 1) determines the peak illumination level requested by a frame to satisfy all pixels in a frame, 2) determines a histogram-based statistical illumination value for the frame, and 3) selects the lower of the two values. The histogram-based statistical illumination value is calculated using an error function for different ranges of illumination levels, wherein the error function correlates with luminance error introduced by selecting next lower range of illumination levels.

23 Claims, 13 Drawing Sheets

BACKLIGHT LEVEL SELECTION FOR DISPLAY DEVICES

BACKGROUND

A backlight module is often used as a light source for display devices such as Liquid Crystal Display (LCD) devices. Illumination level of the backlight can be adjusted low or high. For a high image quality, it is desirable to set the backlight level high (e.g., at the maximum) because setting the backlight level too low adversely affects the displayed image, for example by creating visual artifacts. On the other hand, as display sizes increase and devices become more portable, power conservation concerns become increasingly important. While significant power conservation would be achieved by reducing the backlight level, for example by setting the backlight level at 50% of the maximum, the images would have visual error and noticeable artifacts (e.g., in areas of bright saturated color) with a backlight level that low.

Different methods have been developed to optimize the backlight level by balancing the image quality concerns with the power conservation goals, one of which is to dynamically adjust the backlight level as image is displayed. Today, many new display panel systems utilize some form of this Dynamic Backlight Control (DBLC) to display a high-quality image while reducing power usage.

FIG. 1 depicts a peak-value method that may be used for DBLC. In utilizing DBLC, the backlight setting is adjusted periodically, for example on a frame-by-frame basis. The peak-value method checks all the pixels in a frame to determine which pixel requires the highest backlight level for proper image display, and sets the backlight level for the entire frame at the level that is required by that pixel. In other words, the peak-value method selects a backlight level that is equal to what is theoretically required for a given frame. With the peak-value method, the backlight level for a frame will not be set higher than is requested by the most demanding pixel. Hence, when there are many images that are "dark" such that the backlight level required by the most demanding pixel is low, the peak-value method offers significant power savings.

A weakness of the peak-value method is that it relies too heavily on one pixel. As a result of this reliance on a single pixel, which could be a stray pixel in a frame of hundreds of thousands of pixels, the selected backlight level is sometimes unnecessarily high. In some cases, there is a stray pixel that comes in and out of an image temporally, causing drastic frame-by-frame backlight changes that create flicker. Furthermore, the peak-value method leaves room for further power savings because in some cases, the quality of the image as a whole is uncompromised even if a small percentage of the pixels in a frame do not get the exact backlight level that is requested. Hence, a more sophisticated backlight decision making method is desired.

DETAILED DESCRIPTION

Figure 1:
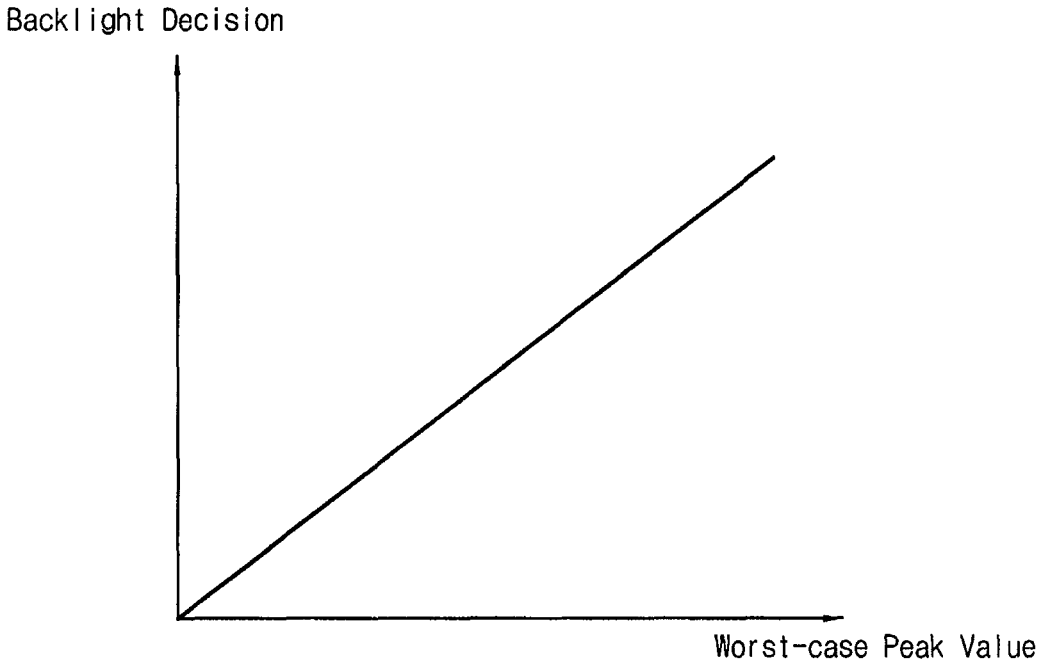
FIG. 1 depicts a peak-value method that may be used for DBLC.

While the techniques described herein apply to legacy RGB stripe systems, they also apply to systems having multiprimary panels (e.g., RGBW) that have more—and possibly different—colored filters than red, green and blue. The inventions herein will be described as they apply to RGBW display systems. However, it will be appreciated that the systems and techniques of the present invention apply as well to multiprimary systems (e.g. RGBY, RGBC, CMYW, etc.) with suitable adjustments. Many of these systems may input legacy RGB image data and perform gamut mapping (GMA) operations onto these multiprimary displays (e.g. RGB to RGBW mapping). Many of these systems may make use of subpixel rendering (SPR) techniques (e.g. particularly on novel subpixel layouts as developed by ClairVoyante) that offer opportunities to enhance visual resolution. It will also be appreciated that the techniques described herein do not rely on the use of GMA or SPR processing and work with conventional RGB stripe display systems that do not have GMA or SPR. It will be understood, however, that the present techniques may work well with such advanced multiprimary systems and may offer benefit over and above what may be possible with such legacy RGB stripe displays.

A "multiprimary" display, as used herein, uses four or more non-coincident color primaries. In a multiprimary display, there are often multiple combinations of values for the primaries that give the same color value. In other words, for a given hue, saturation, and brightness, there may be more than one set of intensity values of the four or more primaries that give the same color impression to a human viewer. Each such possible intensity value set is called a "metamer" for the resulting color. Hence, a "metamer" on a pixelated display is a group of a combination of colored pixels such that there exist signals that, when applied to each group, yields a desired color as perceived by the human vision system. A "pixel," as used herein, is a smallest physical unit in a display device that contains an information. Typically, a "pixel" is of one color and is not limited to being of any specific shape or arrangement. In a traditional display device, a pixel consisted of different-colored subpixels (typically primary colors). However, a more recent phenomenon is to deviate from this traditional concept and arrange the subpixels in creative and innovative ways.

A "module" or "block," as used herein, refers to software, firmward, or a computer-readable hardware device programmed with instructions.

To eliminate the over-dependence on single pixels suffered by the peak-value method and create a more averaged statistic of an image frame as a whole, a histogram-based statistical method was developed. The histogram-based method is described in pending U.S. patent application Ser. No. 12/123,414 filed on May 19, 2008, which is incorporated by reference herein and which has the same Applicant as the present application. Presented herein is a hybrid method that combines the peak-value method with the histogram-based method to take advantage of the strength of each method. In most cases, the histogram-based method offers better power savings than the peak-value method and smoother transition between images (i.e., less or no flicker). However, there are cases where the peak-value method offers better power conservation. The hybrid method presented herein provides a way to determine, e.g. on a frame-by-frame basis, which method to apply to obtain maximum power savings without compromising image quality.

Input Gamma Processing

As shown, Input Gamma block 104 processes the input image data to linearize it, often with an input gamma LUT. However, display systems often introduce quantization error when doing calculations on the data flowing through the pipeline. Introducing some dithering on the input side of the pipeline may decrease the quantization error. In a system with SPR, patterned input dithering may be substantially filtered out, resulting in decreased quantization noise with no side effects. Input Gamma 104 is used to adjust for gamma if the display is of the type that needs gamma adjustment (e.g., LCD), and may be omitted depending on the type of display.

Gamut Mapping Application (GMA)

After the gamma adjustment, signals exiting Input Gamma 104 is fed to Gamut Mapping Application (GMA) 106, which converts a linearized version of the traditional RGB data into multiprimary or RGBW image data. Techniques of GMA are well known. If the data is to be subpixel rendered onto the display, then GMA block 106 may comprise an optional subpixel rendering processing (SPR) block. Such may be the case if the display comprises any one of a novel subpixel repeating group. SPR processing techniques are well known.

Backlight Decision

A refinement on conventional displays may occur in a manner in which dynamic backlight control (DBLC) functions upon image data. To take one exemplary RGBW system, a system having a GMA module will typically apply a RGB to RGBW gamut mapping that converts white and desaturated colors to RGBW values that fall within a valid range (0% to 100%). Assuming that the transmissivity of a RGBW system (or other multiprimary displays) may be twice that of an RGB stripe reference system, only 50% backlight power may be required to represent such desaturated colors in many or most instances.

However, input RGB colors that are highly saturated are mapped to RGBW values that exceed 100%, making such values invalid or "out of gamut" (OOG). Pure colors typically map to RGBW values where at least one of the color channels reaches 200%. To properly render such pure colors, the data may be simultaneously scaled down by 50% to reach the valid data range and the backlight power may be doubled to 100%. This simultaneous scaling down of data values (which translates into the degree of transmissivity of the light valve) and scaling up of backlight values is how the DBLC system reconstructs and renders colors accurately; the goal is to generate valid data values and to adjust the backlight level to maintain accurate luminance values.

If the data values were always scaled down by 50% and the backlight were always scaled up to 100%, colors would be accurately rendered but there would not be any power savings benefit. In order to save backlight energy, the DBLC may aim to survey the RGBW data values of all pixels in a frame and then determine the lowest backlight level (and the largest data scale factor) to accurately render even the most-demanding colors in that frame. Generally, when bright pure colors (such as bright yellows) are present in the frame, the backlight level may tend to approach 100%. When bright whites and bright desaturated colors are present, the backlight level may tend to approach 50%. When dark desaturated colors are present, the backlight level may tend to dip below 50%.

Figure 2:
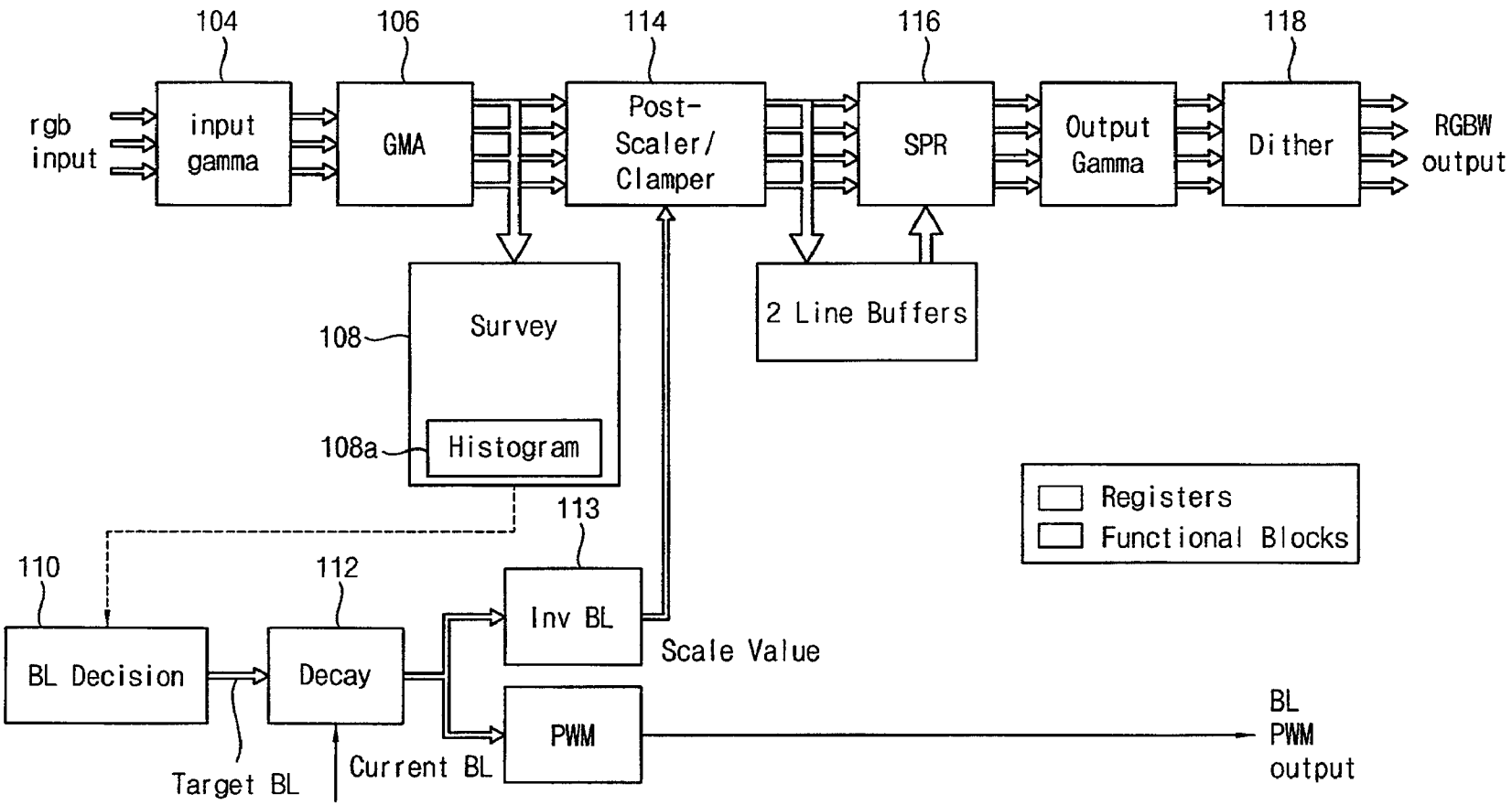
FIG. 2 is one embodiment of a display system made in accordance with the present invention.

As indicated in FIG. 2, signals coming out of Gamut Mapping Application 106 may take two paths—one for DBLC and one for control of the display. For control of the backlight, the signals exiting GMA 106 are surveyed by Image Surveyor 108, which gathers certain image data statistics to determine whether a present frame (or portion thereof) is part of a same or similar scene or represents a change in scenes that might require a large change in the backlight illumination vis-à-vis the previous frame. Part of the Surveyor 108 is a Histogram Generator **108*a*. Details on the Surveyor 108 and the Histogram Generator 108*a*** are provided below.

Backlight Decision block 110 decides the backlight level for a current frame by combining the result of the histogram produced by the Histogram Generator **108*a* and the result of the peak-value method. More specifically, the Backlight Decision block 110 determines a target backlight illumination for the current frame (or portion thereof) and a smoothing function (from perhaps a set of suitable functions) to change the illumination of the backlight from a current value to the target value in such a way as to minimize visual artifacts. Decay block 112, described below, could provide further control of backlight signals. Such further control may be fed to both the backlight and to a post-scale block 114**, as will be discussed further.

The DBLC may be thought of as having two parts: the first part is to survey or gather statistics on the backlight requirements of all pixels in the current frame, and the second part is to make a backlight decision and appropriately scale the data values consistent with that decision. For example, the survey portion of the DBLC method of the invention may populate a histogram data structure for the histogram-based method and identify the backlight level requested by the most-demanding pixel for the peak-value method. Then, a backlight decision is made by traversing the histogram data structure and comparing the result with the peak-value result.

In one embodiment, image data statistics are taken on a frame-by-frame basis. Although FIG. 2 depicts the survey to be done just after signals exit the GMA block 106, this is not a limitation of the invention and image data statistics may be derived at any other appropriate point within the image processing system of FIG. 2. For example, image data statistics may be taken off of the initial input image data—whether that input image data is legacy converged RGB data or data in any other format. Additionally, the present system may take the statistics off of any optional post-GMA image data—for example, image data that has been mapped e.g. from RGB to RGBW. Further, the statistics may be taken off of image data that has been (optionally) SPR filtered for rendering onto the display. Performing the survey on the input data may require fewer gates because there may be fewer input primaries (e.g. 3 for RGB vs. 4 for RGBW). Alternatively, performing the survey after the GMA may require fewer gates because some of the calculations necessary for the survey may have already been performed. Alternatively, performing the survey after the SPR module may allow DBLC to be used in a system that only updates a portion of the display at a time.

Figure 3:
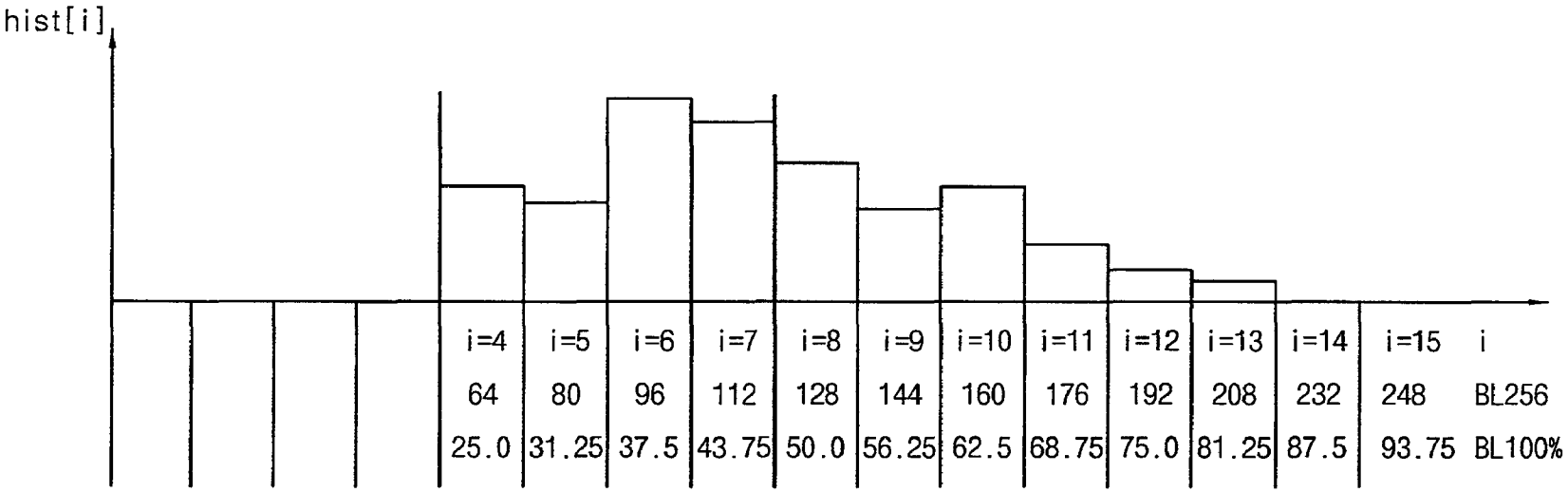
FIG. 3 shows the diagram of an exemplary histogram plot of backlight requirements of exemplary image data versus a bin count of such exemplary image data.

Now, the histogram-based method will be briefly described. FIG. 3 depicts an example of a histogram with 16 "bins" (labeled i=0 to 15), the bins representing non-overlapping ranges of digital illumination values. The vertical axis in the histogram shows the number of pixels in each bin, and the horizontal axis shows the backlight level. During the survey process, a determination is made as to what level of backlight illumination is requested (or required) by each pixel in a frame. Based on the backlight level requested, each pixel is added to one of the 16 bins in the histogram that has a backlight level range encompassing the backlight level of that pixel. Hence each element, hist[i], aims to store a value proportional to the number of pixels in the given frame that fall within the range of the i-th backlight bin.

In a simple example of a fully red pixel value (i.e. R=255, G=B=0), such a fully red pixel would request/require that the backlight be fully-on. Hence, that pixel would contribute to the count in the highest bin (i=15 in the case of FIG. 3) being incremented by one.

In the histogram of FIG. 3, the bin on the x-axis farthest away from the origin is the bin representing the highest backlight level. The particular backlight used for FIG. 3 has 256 illumination levels, and the highest bin represents illuminations levels 248-256. Although 16 different bins are shown in FIG. 3, the invention is not limited to a specific number of bins and the number of bins is variable. In fact, there could be as many bins as discrete illumination levels (256 bins in the case of FIG. 3, each bin representing one illumination level). As the surveyor examines each pixel, the pixel count in one of the bins gets incremented.

In some embodiments, the counters for the bins could be capped at a certain level (and not provide a full count of all possible image data values in a frame). For example, supposing the display in question is a VGA screen having over 300K image data values, then for a histogram having e.g. 16 bins, each bin could be capped at some number (for example, 16K values) before throwing away any additional image data points at that value. As 16K is approximately 5% of the total number of image data values in the total frame for VGA, this may be enough data to make an intelligent selection of backlight values and light valve values.

In order to fill the bins, a metric that correlates a given pixel value to a backlight illumination value may be used. In one such metric embodiment, the minimum backlight requirement, BL_req, for a pixel being displayed may be considered as proportional to the maximum of its component R,G,B,W values. The channel with the largest value dictates the backlight requirement.

For example, in linear RGBW space, the minimum backlight requirement is proportional to mx (R, G, B, W), as follows:

$$BL_\text{req}\ \alpha\ \max(R,G,B,W)$$

As each pixel in a given frame is processed, the minimum backlight requirement of each pixel may be calculated and used to select the appropriate backlight bin and to increment the count value of that bin as follows:

$$\text{backlight bin } i=(BL_\text{req}/\text{maximum backlight value})*(\text{total number of bins}).$$

If current pixel falls within the category defined by backlight bin i, increment the count value of that backlight bin as follows:

$$\text{hist}[i]=\text{hist}[i]+1.$$

As discussed above, each counter for a given bin could be uncapped, or capped at a certain value that gives a meaningful measure of the backlight requirements of the current image to be displayed. In one embodiment, a cap range of 2-5% of the total number of pixels in an image may be reasonable. Other caps are possible.

Although the BL_req equation above gives one exemplary measure of the backlight requirement for a given pixel, other measures are possible. For another embodiment, it is possible to apply color weighting terms—either prior to calculating the minimum backlight requirement or afterwards. For example, the color channels data R,G,B,W may be individually be multiplied by color weighting terms, RWT, GWT, and BWT, consisting of values, e.g. less than 1, so that the backlight requirement of pure colors can be reduced to less than 100%. This method may result in some intentional color luminance drop, yet color weighting may be considered an alternative feature in tuning the DBLC system and algorithm toward more or less aggressive power savings, as is desired.

For example, errors in displaying blue are often difficult for the human visual system to detect. Setting the BWT value to 50% may allow the backlight to drop 50% lower than necessary to correctly display blue pixels. The blue values may then need to be scaled or desaturated to bring them back into gamut but in the case of blue this error may not be very apparent in blue. Red and Green may be scaled by less, by numbers closer to 100%, without introducing unacceptable error.

Moreover, other color (e.g. yellow, magenta, or cyan) weighting term (e.g. YWT, MWT, CWT respectively) may be used to act more or less conservatively, as desired. For example, yellow—which is the brightest of all pure colors and most susceptible to perceived luminance error—may be used to be more conservative. A yellow weight may serve to further raise the value of the red weight and thus raise the backlight requirement when both bright red and bright green are present. As another alternative, a white weighting term, WWT, may be included and may typically be set to unity but may be adjusted to slightly less than 1 for aggressive settings that may allow some loss in peak white luminance in order to achieve backlight levels less than 50%. Thus, in one embodiment, the resulting color weighting expressions (given in linear RGBW space) and backlight requirement calculation may be as follows:

$$R=R*(\text{RWT}+(\text{YWT}-\text{RWT})*G)\ (\text{where YWT}>=\text{RWT})$$

$$G=G*\text{GWT}$$

$$B=B*\text{BWT}$$

$$W=W*\text{WWT}.$$

Figure 7:
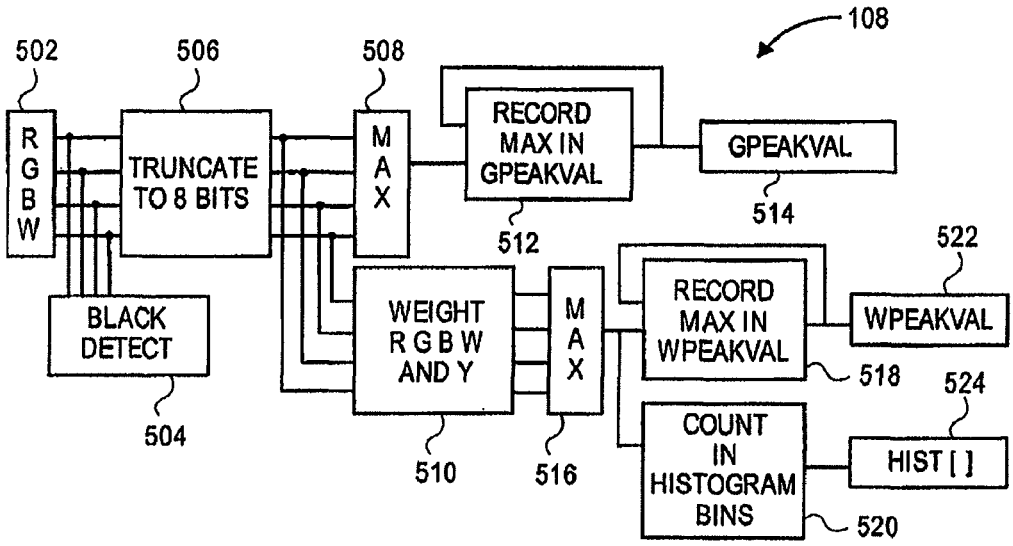
FIG. 7 is one embodiment of an image data survey module.

FIG. 7 depicts one embodiment of a survey module 108 shown in FIG. 2A. Image data (e.g., having an RGBW format) is input in block 502. The RGB and W input values may be truncated (at 506) to their upper (e.g. 8) bits. These upper bits may include the Out Of Gamut (OOG) bit so that out-of-gamut values may still be represented. If global variable scaling is desired, the maximum of the truncated RGBW values may be calculated (at 508) for each pixel and the global maximum value is accumulated (at 512) in an 8-bit gpeakval register (at 514) for the whole image.

If the input values are truncated, the peak values may no longer be a reliable indication of a completely black image. It may be desirable to detect this (at 504), for example by OR'ing all the bits in all the primaries in all the pixels together or by any other manner. In the pseudocode below, the OR of the primaries of all the pixels in the image may be stored into an 11-bit register named black_detect and checks this for zero in the calc LED and gain module as described further below.

After truncation, the RGBW values may be individually scaled by separate color weights (at 510). In one embodiment, R is multiplied by 0.85, Gby 0.70 B by 0.50 and W by 1.00. This may be efficiently done by multiplying each primary by a register value between 0 and 256 then right shifting the result 8 bits. The Y weight value weighs yellow values separately from the primary colors. This may be used as a modification of the red weighting value as a function of the green value. In this example, the primary values have all been truncated to 8 bits now and this may only require 8-bit calculations.

The maximum of the 4 RGBW primary values after weighting may be selected (at 516) for each pixel and then the maximum weighted primary for the whole frame may be accumulated in an 8-bit wpeakval register (at 516, 518 and 522).

The maximum of the weighted RGBW values may also be used to accumulate counts in a histogram (at 520 and 524). The maximum weighted RGBW value may be converted to an index by extracting the upper 4 bits. This may implement a histogram with 16 bins, although the lower 4 bins may not be implemented since we do not set the LED power below 25%, as explained above. The bin indexed is incremented by one and clamped to a cutoff maximum.

The counters in the histogram may have a fixed number of bits (typically 14) and thus may not count higher than $(2^{14}-1)$ or 16,383. When a histogram counter reaches this limit, it stops counting and holds the maximum value. This maximum count is referred to as a "cutoff" in the pseudo code implementations. The histogram threshold THH1 is a number between 0 and this cutoff. A THH1 value set at 0 is conservative and will tend to choose a high backlight value. A higher THH1 value is more aggressive and will tend to choose a lower backlight value to save more power. A full bin may stop the search and set the power level.

The following is pseudocode (in Lua code) that represents an exemplary survey module. The simulation allows setting the size of the histogram with hist_bits, the number of bits in the gamma pipeline with GAMBITS (currently 11), the number of bits in the weight values with SBITS (8) and the number of bits in the histogram counters with cutoff (14). These parameters may be fixed bit sizes in any particular implementation of the hardware:

```
function dohisto(x,y) -- scan one pixel and accumulate statistics
local r,g,b,w=spr.fetch(pipeline,x,y) --fetch the post GMA data
        --OR all the bits in all the primaries in all the pixels
black_detect = spr.bor(black_detect,r,g,b,w)
r = math.floor(r/(2^(GAMBITS+1-SBITS))) --hack out the upper
8 bits only
  g = math.floor(g/(2^(GAMBITS+1-SBITS)))
  b = math.floor(b/(2^(GAMBITS+1-SBITS)))
  w = math.floor(w/(2^(GAMBITS+1-SBITS)))
  local peak = math.max(r,g,b,w)
  gpeakval = math.max(gpeakval,peak)          --record global maximum
if weighted_color==1 then          -- weighting formula:
            -Rweight increases to affect yellow
    local Xweight = Rweight + ((Yweight-Rweight)*g/(2^SBITS))
    r = math.floor(r*Xweight/256)
    g = math.floor(g*Gweight/256)
    b = math.floor(b*Bweight/256)
    w = math.floor(w*Wweight/256)
  end
  local maxp = math.max(r,g,b,w)
  wpeakval = math.max(wpeakval,maxp)    --record weighted maximum
                --build a histogram of maxp values
                --upper hist_bits of maxp is index
  local i = math.floor(maxp/(2^(SBITS-hist_bits)))
  hist[i] = math.min(cutoff,hist[i] +1) --count them but clamp
end--function dohisto
```

Once the histogram (or other suitable data structure) has been completed for the current image frame, the BL Decision block 110 uses the completed histogram to intelligently set a backlight illumination level for the frame that simultaneously minimizes backlight power consumption and the amount of image rendering error. The BL Decision block 110 uses the histogram to select a first illumination value, uses the peak-value method to select a second illumination value, and performs a MINIMUM operation on the two illumination values to determine the illumination value to be used. The minimum produces a hybrid result that behaves optimally both for a case with stray bright pixels (which are not good for the peak-value method) as well as gamma-style measurements (which ideally should produce fine steps in backlight decision but instead produce coarse backlight decision steps using the histogram method). For most images, the worst-case peak value will be higher than the histogram-based backlight decision. Thus, the histogram method will end up determining the backlight setting majority of the time. However, for gamma measurements and images without any filtered-out pixels, the peak value will tend to be lower than the histogram-based value, which would favor the high-end of the backlight decision range when the associated bin was full. Thus, the peak-method would determine the result in these cases.

In one embodiment, the bins that represent the highest backlight power requirements may be analyzed first to determine if the backlight power can be reduced to a level lower than maximum without significantly jeopardizing the backlight needs of the majority of the pixels in the image frame. It would be understood that the order of processing the bins or the data structure may be changed without departing from the scope of the present invention.

During the course of processing the data in the histogram, it may be possible to maintain an error measure that may be used to end further processing when the error measure has reached some possible threshold or thresholds. Such threshold(s) may be determined heuristically according to some rules of human vision or empirically by polling users viewing images with varying backlight illumination.

To determine the illumination level according to the histogram-based method, a backward traversal method may be applied to the histogram. In a nutshell, during the backward traversal, the bin (i=15) representing the highest illumination level is first examined to see how many pixels fall in that bin. If the pixel count in the highest bin (i=15) is below a threshold number, the number of pixels that were in the highest bin (i=15) is added to the next highest bin (i=15), and the total pixel count in the second highest bin (i=15) is examined. If the total pixel count in the second highest bin (which is the combined number of pixels from what was in the highest bin and the second highest bin) is still below the threshold number, then all the pixels in the i=15 bin are added to the next highest bin (i=14) and the third highest bin (i=14) is examined. This process is continued until the threshold number is reached.

Figure 4:
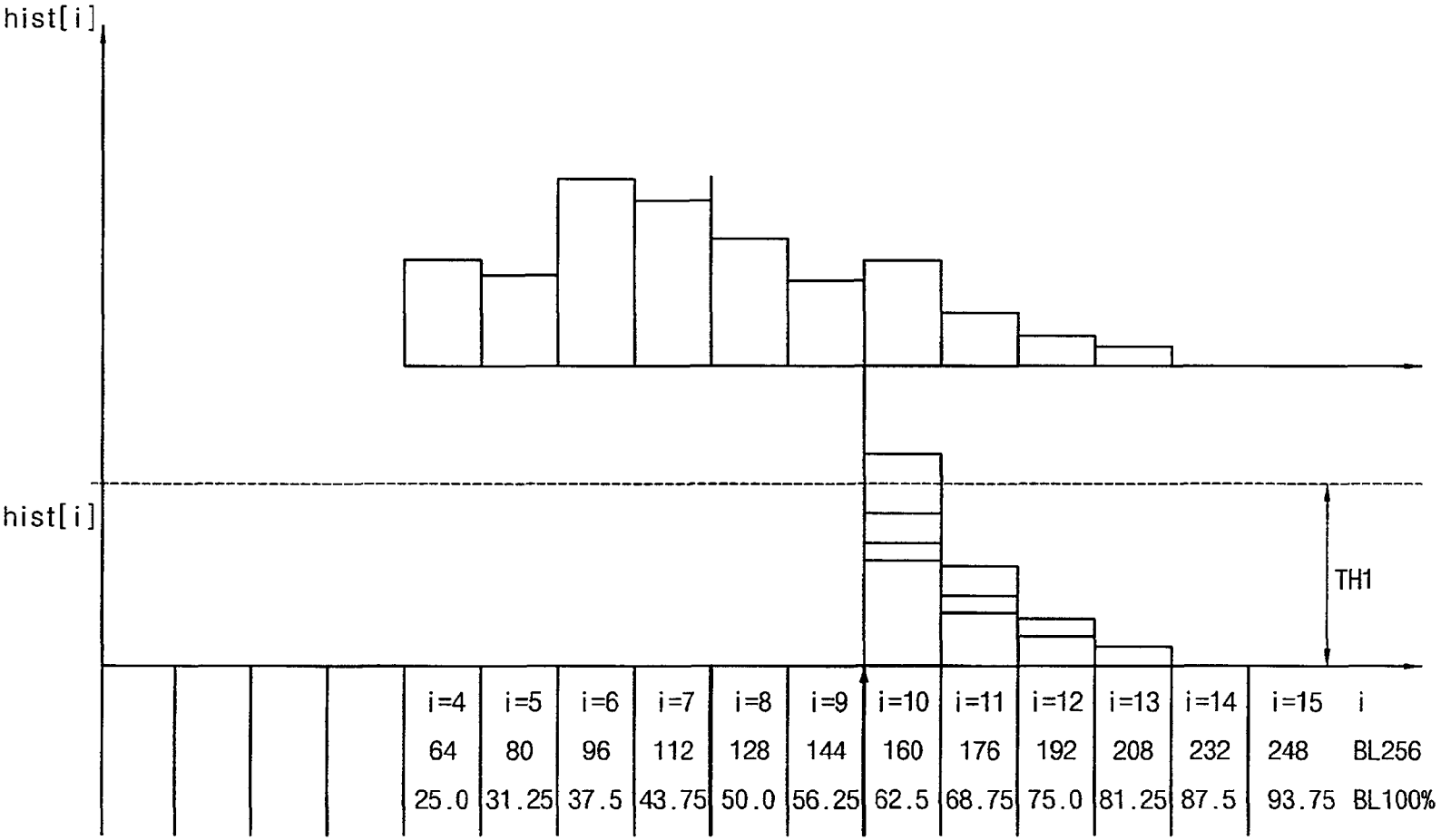
FIG. 4 depicts one embodiment of the processing of a dynamic backlight control module to find an acceptable backlight power setting.

FIG. 4 shows an error function E_sum that may used in accumulating the amount of perceived luminance error that might be introduced if one were to progressively disregard the backlight power requirements of each power bin starting, for example, from the bin representing the highest backlight power requirement category and continuing through to the bin representing the lowest backlight power requirement category. Alternatively, an accumulation of reducing error could be maintained and processed from the bin of least backlight power requirement and continuing to highest until the error is reduced below a certain threshold. The traversal is preferably done after the end of the current frame.

In the case of backwards traversal from the highest power requirement bin of the histogram, if the perceived accumulated error E_sum[i] associated with a particular bin exceeds an acceptable error threshold TH1, then the associated backlight requirements of that bin is preserved and the backlight decision is therefore deduced from the that bin.

In one embodiment, the perceived accumulated error function E_sum[i] may take into account the number of pixels that would be compromised if the traversal were to continue to the next lowest power bin. Additionally, it may also include a multiplicative compound factor (typically greater than 1) to represent the non-linear escalation of perceived error as one traverses to lower backlight bins.

In the particular example of FIG. 4, there are no pixels in either bin i=14 or i=15. Thus, it is safe to reduce the backlight level to at least digital value 232 (out of a possible 255 in this example) without any visual error induced. Now, starting with bin i=13, a small number of pixels sampled are requesting or requiring a level of backlight somewhere in that bin—somewhere between digital values 208 and 231 in this example. As is seen, the level of error is below the threshold, so the BL Decision module 110 continues considering even lower backlight power possibilities, moving on to bin i=12. The BL Decision module 110 continues in this fashion until bin i=10, when the error threshold TH1 is finally exceeded. The highest bin that exceeds the error threshold is herein referred to as the "critical bin." The backlight illumination level, thus, is set at a value between 160 and 175.

Once the critical bin is identified, there are different ways to select the exact backlight value from the range that is covered by the critical bin. In one embodiment, the backlight power may be selected to match the highest level in the selected bin (bin i=10), which in this example is digital value 175. While this may be a "safe" choice in terms of error, it may be possible to be a little bit more aggressive in terms of power savings, as described below.

Alternatively, additional process employing an additive fine_adjust_offset function may be used in selecting only one of the backlight levels within the range of backlight values represented by a bin. In one embodiment, a fine_adjust_offset of zero would keep the backlight value at the lower bound of the range, and the maximum value of the fine_adjust_offset function adds a component that brings the backlight value up to the upper bound of the range.

```
E__sum[hist__size]=0
For i = hist__size−1 down to 0        (hist__size is total number of bins)
  E__sum[i] = (compound__factor * E__sum[i+1]) + hist[i]
          (compound factor may be greater than or equal to 1)
  If E__sum[i] >= TH1 then
    Backlight = i / (hist size) * maximum backlight value +
    fine__adjust__offset
```

Figure 6:
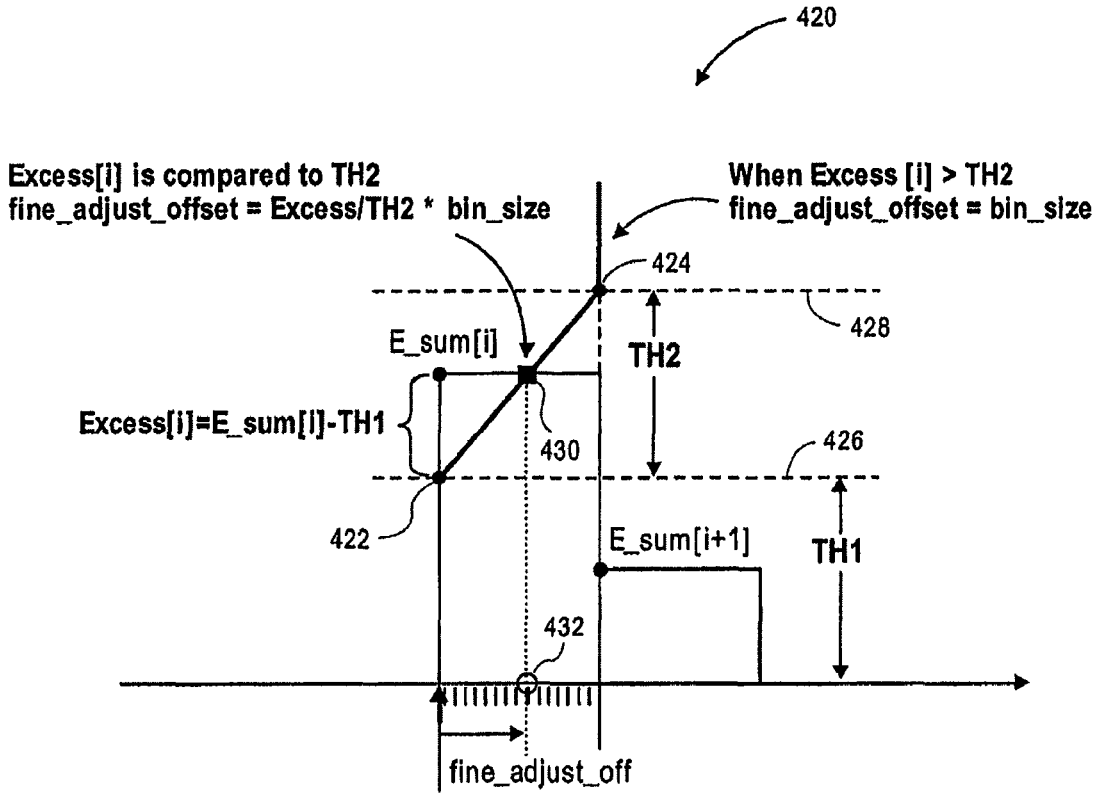
FIG. 6 shows another embodiment of additional processing to refine the setting of acceptable backlight power.

Assuming that E_sum[i] exceeds the threshold TH1, and by inference the previous E_sum[i+1] in the reverse traversal (in the example above) did not exceed the threshold, then an E_sum trend line can be drawn from E_sum[i+1] to E_sum[i] as shown in FIG. 6. The fine_adjust_offset theoretically matches the point where the E_Sum trend line crosses the threshold TH1. The ideal fine_adjust_offset would therefore be computed as follows:

```
fine__adjust__offset = ((E__sum[i]−TH1) /
(E__sum[i]−E__sum[i+1])) * (max backlight value/number of bins)
```

Figure 5:
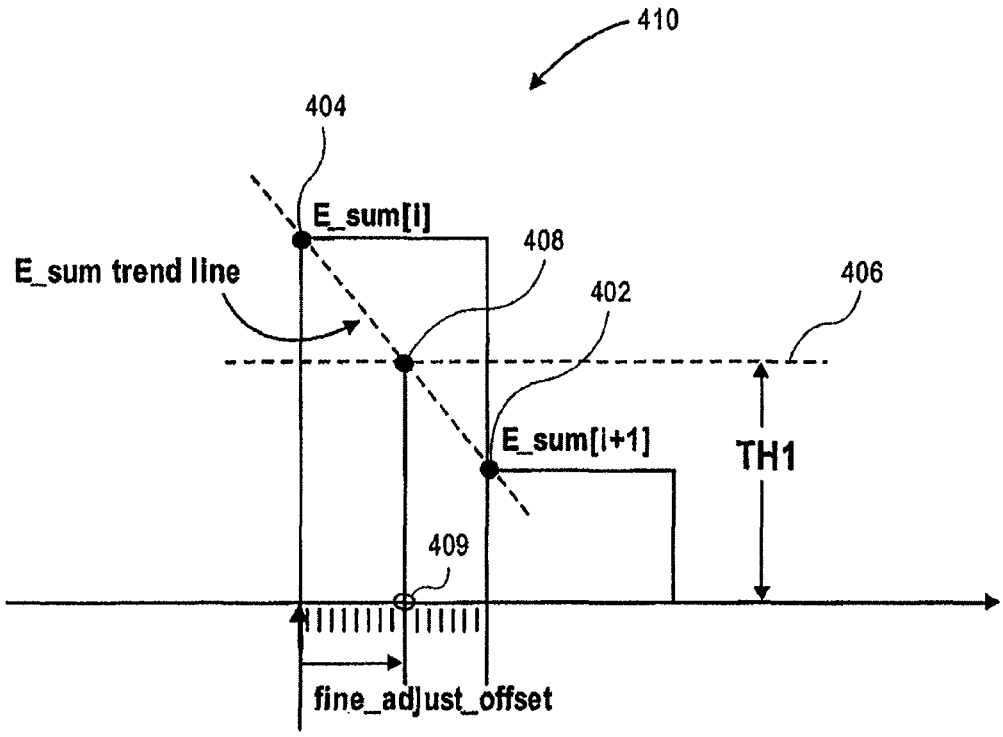
FIG. 5 shows one embodiment of additional processing to refine the setting of acceptable backlight power.

FIG. 5 depicts one embodiment of the processing of the fine_adjust_offset. As may be seen, two lines–one line, as defined by lower edge points 404 and 409 of the two adjacent bin and a second line, as defined by the TH1 error threshold 406—may be solved simultaneously and the intercept point 408 may be dropped down to the x-axis to determine fine adjustment offset 409.

FIG. 6 depicts yet another embodiment of the processing of the fine adjustment offset. Simplifications may be applied to make the fine_adjust_offset calculation of FIG. 5 easier in hardware as well as yield reasonable approximations of the ideal. One possible simplification may take the excess error defined by E_sum[i]−TH1 and compare it with a second threshold, TH2, which may be a power of 2. In this case a quotient is easily calculated and a fine_adjust_offset similar to the ideal is generated as follows:

$$\text{fine_adjust_offset}=((E_\text{sum}[i]-TH1)/TH2*(\text{max backlight value/number of bins}).$$

As may be seen, two lines–one line, as defined by edge points 422 and 424 of the two adjacent bin (as measured by two error thresholds TH1 and TH2) and a second line, as defined by the E_sum[i]—may be solved simultaneously and the intercept point 430 may be dropped down to the the x-axis to determine fine adjustment offset 432.

Internal limits for the backlight allow a range from 25% to 100%. Within this range, the backlight decision may be further clamped to lower and upper bounds determined by MNBL and MXBL register settings. If the image is completely black (all zero data), then the minimum backlight setting is ignored and the DBLC backlight level will go to zero.

Backlight=max (Backlight, MNBL, 25%) or 0% if the image is completely black

Backlight=min (Backlight, MXBL, 100%)

Figure 8:
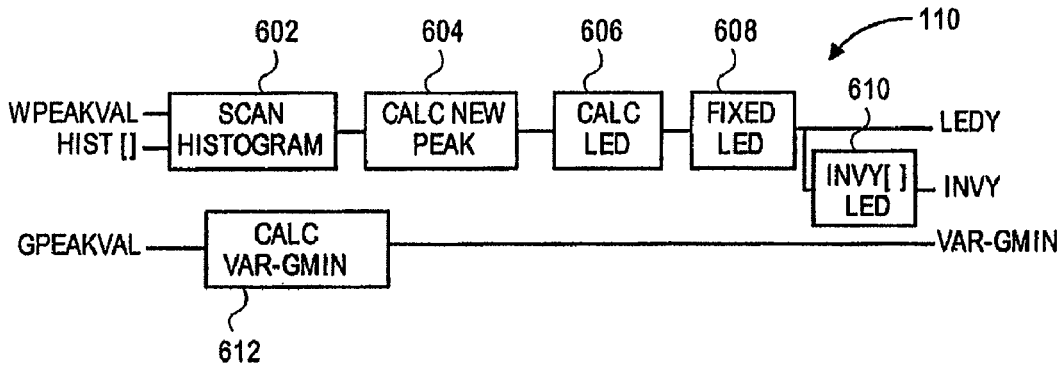
FIG. 8 is an embodiment of the Calc LED and gain module.

FIG. 8 depicts one embodiment of the Backlight Decision module 110, which takes the statistics collected by the survey module 108 during a frame and performs calculations during the vertical retrace time. The BL Decision module 110 scans the histogram (at 602) to calculate a modified peak value (at 604). The histogram bins are summed from the highest down until the sum exceeds the threshold value THH1. The sum may be compounded by multiplying its previous value by a small number near 1.0 on every cycle. A 3-bit fixed point fraction from the CMP register may be used to set this compounding factor. Three bits allows multiplying the previous sum by eight values between 1.0 and 1.875.

Figure 9:
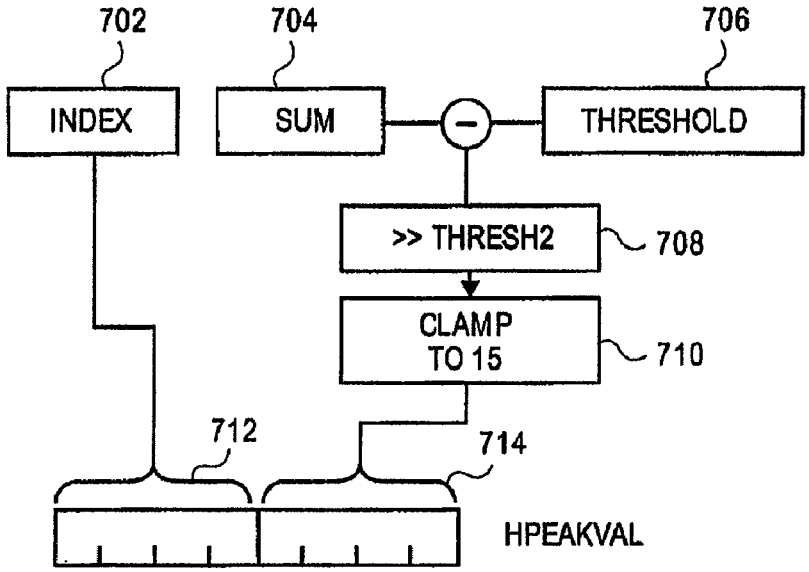
FIG. 9 is an embodiment of a module to create a histogram.

FIG. 9 shows an embodiment of the Backlight Decision module 110 whereby the chosen histogram index (at 702) is used to calculate a new peak value (as represented by 712 and 714). However, if just the histogram index were used, then only 16 (or whatever the hist_size may be) values may be chosen. The lower bits of the peak value may be constructed in the following way: when the search of the histogram stops, the sum (704) is always greater than the threshold (706). Subtracting the threshold from the sum will then produce a value between 1 and cutoff+1, perhaps more if the compound multiplier is large. The result of the subtraction is right shifted by a shift counter called THH2 (at 708). If the compound multiplier is 1.0 and THH1 is large, then a THH2 value of 10 bits will result in a 4 bit number which can be used to fill in the lower 4 bits of the new peakval. Some combinations of these settings can cause this value to overflow so the result of right shifting by THH2 must be clamped to a maximum value of 15 (0x0F) (at 710). In one embodiment, there may be some interaction between the values of THH1, THH2 and the compounding multiplier CMP. For example, as the value of the compounding multiplier goes up or the value of THH1 goes down, the value of THH2 should go up (e.g. not higher than 12 or some other suitable value).

For alternative embodiments, it may be advantageous to use different threshold values for darker colors (e.g. THL) than those for brighter colors (e.g. THH). The variables THH1 and THH2 may be used when examining the histogram bins above the half way point. The variables THL1 and THL2 are used in the histogram bins below the half way point.

In the case when the peak value size (SBITS) is equal to the size of the LED power settings (LEDBITS), the resulting peak value can be directly used as the LED power setting.

As an alternative embodiment, it has been desirable to have a method of forcing the LED power to a fixed value. This feature may be useful for hardware testing or to produce required power consumption levels.

If the LED power is below 25% of the maximum backlight level, it may be raised back up to the 25% setting. When the image is black, as indicated by the black_detect bits from the survey module, the LED power may be forced to one.

Figure 10A:
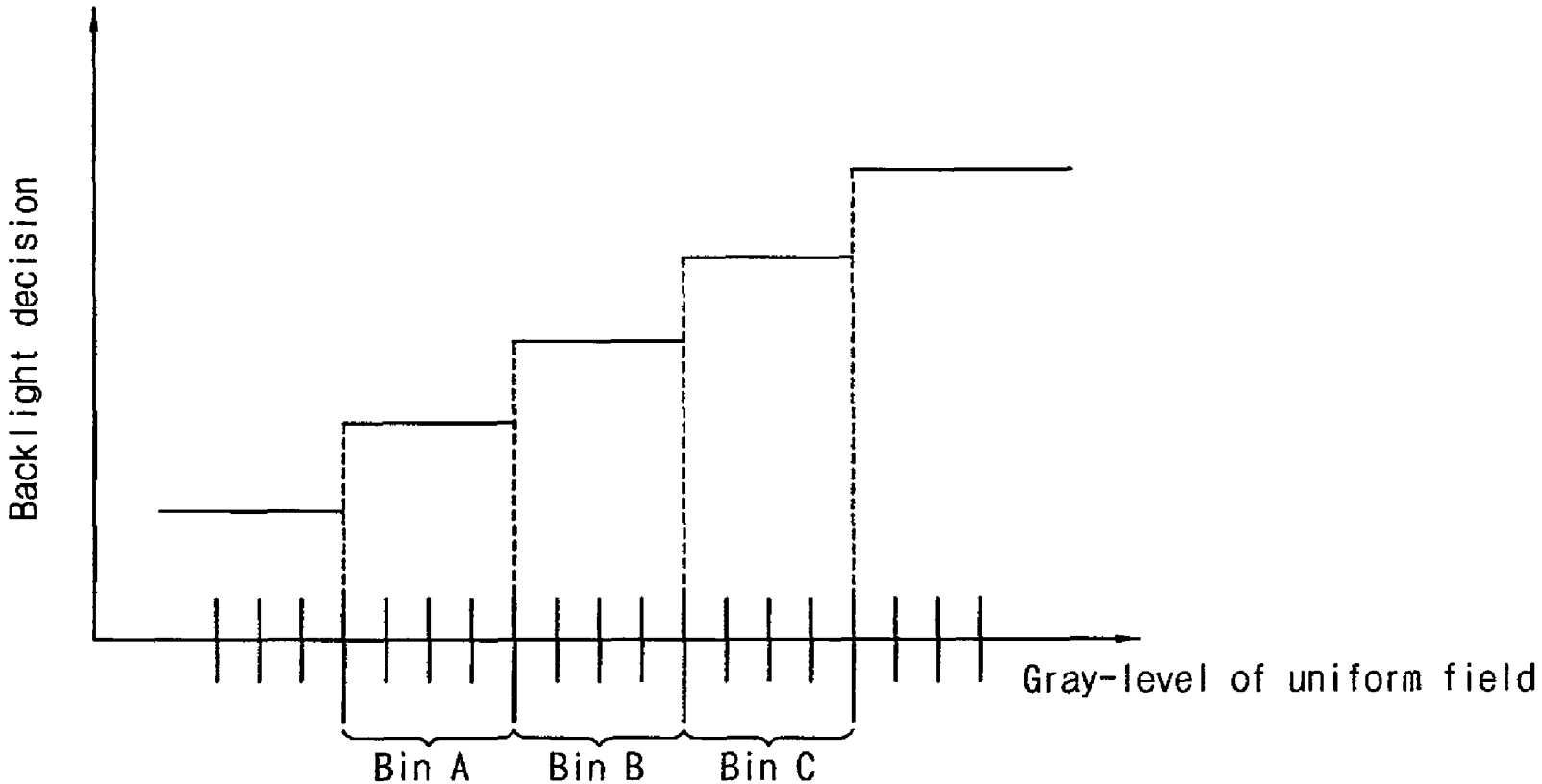
FIG. 10A is a plot of backlight decision as a function of gray level showing the results of histogram-based method.

FIG. 10A is a plot that demonstrates the histogram-based backlight decision. The vertical axis of the plot indicates the backlight illumination level and the horizontal axis indicates the gray level of a uniform field. The histogram-based method may pose a problem in some situations. For example, if there is an image where all pixels fall into Bin C, such as a uniform field of gray, information about that gray level is only generally maintained (as falling into a bin that covers a range of gray levels) and cannot be differentiated from a slightly higher or lower gray level or a combination of grays within the same bin. The different gray levels produce the same backlight decision.

This behavior may become problematic considering the testing environment for gray-level gamma measurements. Since minor gray-level changes within the range of a single bin will not produce different backlight decisions, the backlight response vs. gray level will appear in steps instead of a ramp. Although the luminance measurement of a temporal gray ramp will not appear in steps as shown if the DBLC will produce LCD data values to inversely compensate the backlight decision, it is desirable for the backlight decision response to behave smoothly, like the peak-value method in FIG. 1. Furthermore, it is desirable to optimize for lower backlight levels where a gray level is on the lower end of a bin's range.

Aside from gamma measurements, a little more power savings could be gained by using the hybrid method. Additionally, a smooth backlight response may result in an overall improved visual smoothness as images transition from one frame to another, as LCD data values inversely compensate a smoother backlight decision.

Figure 10B:
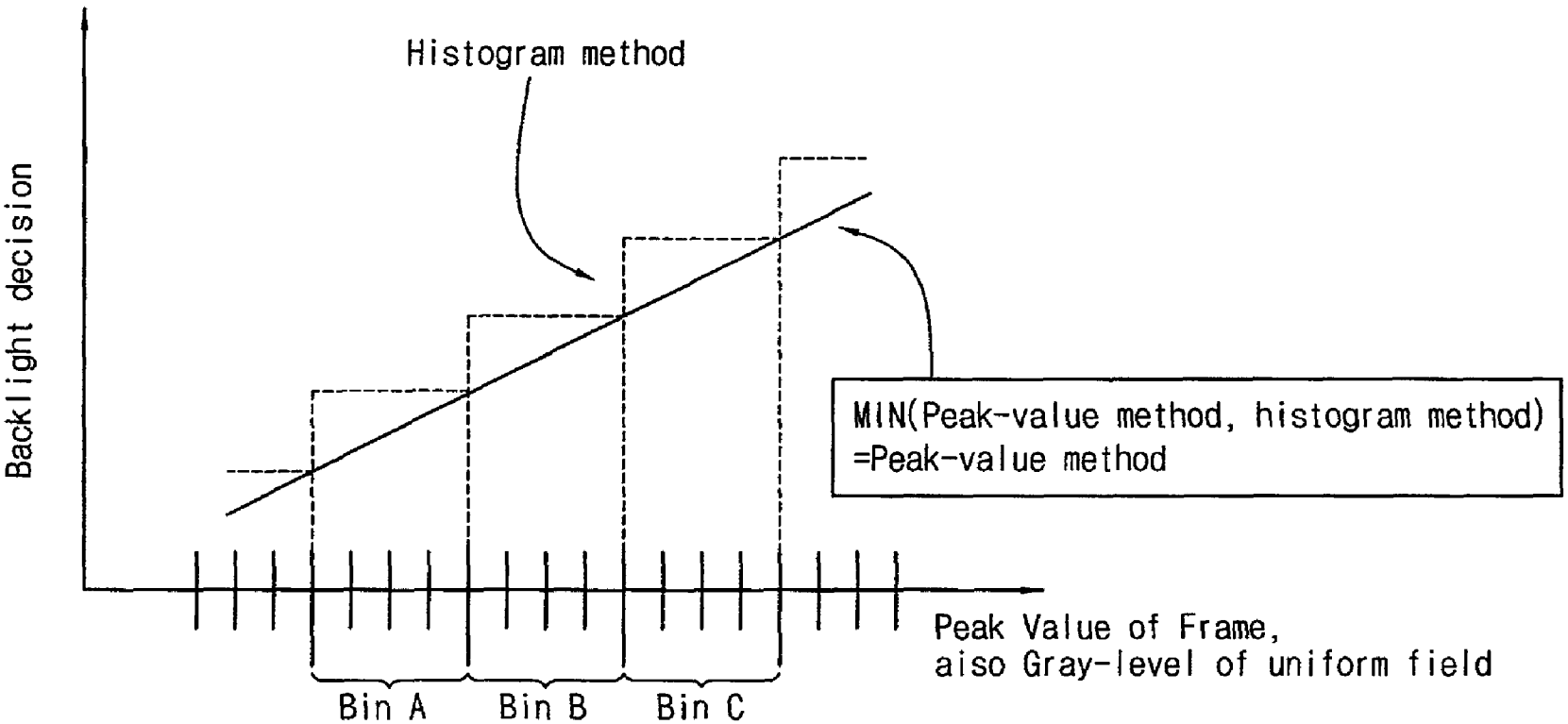
FIG. 10B is a plot of backlight decision as a function of gray level showing the results of hybrid method.

For most real-world images (not test images), the illumination level chosen by the peak value method will be higher than the level chosen by the histogram method. Hence, the histogram method will determine the backlight decision most of the time, even with the hybrid method. However, for gamma measurements and images without any filtered-out pixels, the peak value method will produce an illumination that is lower than that of the histogram method, especially if the histogram method favors the high-end of the illumination levels covered by the critical bin. FIG. 10B depicts the result of the hybrid method, and shows the smooth backlight response during gray-level testing.

In implementing the hybrid method, both the histogram statistics and the peak value are collected by the survey module 108 as data for one frame is surveyed. As the histogram data is collected (incrementing counters for each bin), the peak value (referred to as wpeakval) is iteratively determined by comparing the current pixel value (pixelval) with the saved peak value and keeping the higher one, then repeating this process until the survey is complete for the entire frame:

$$Wpeakval=MAX(wpeakval, pixelval)$$

Using the survey result, the Backlight Decision module 110 determines the histogram-based backlight value (hpeakval) in the manner described above. Then, the backlight decision is made as follows:

$$Backlight_Decision=MIN(wpeakval, hpeakval).$$

In one embodiment, the peak value is not maintained per frame but per bin per frame. In other words, there would be as many local peak values as there are bins. Then, when the histogram method selects a critical bin, the local peak value for the critical bin would be utilized for the final decision between the peak value method result and the histogram method result.

The local peak method can be implemented using wpeakval_1, wpeakval_2, . . . wpeakval_N wherein N is the number of histogram bins. During the survey, each of these values is compared against the current pixel value (pixelval) only if pixelval is in the same bin range. The method can be summarized as:

$$wpeakval_1=MAX(wpeakval_1, pixelval) \text{ if pixelval is in the range of bin 1}$$

$$wpeakval_2=MAX(wpeakval_2, pixelval) \text{ if pixelval is in the range of bin 2}$$

and so on until wpeakval_N is determined. Then, after hpeakval is determined using the histogram method, the backlight decision is the minimum of hpeakval and the wpeakval that corresponds to the same bin range as hpeakval.

As an alternative, an average value may be maintained for each bin instead of local peak values. The average value would take into account the number of pixels having each illumination level covered by the critical bin, and would filter out stray pixels to provide a more accurate representation of the illumination level region.

Decay Delay Module

Temporal artifacts may be visible when large changes in the backlight brightness and compensating LCD values occur. When a given portion of an image changes brightness or saturation, from one frame to another, such that it becomes desirable to change the backlight brightness, either brighter or lower, another portion of the image may not have changed. Thus, the change in backlight brightness may be accompanied by an opposite change in the LCD value. However, although the LCD is commanded to change instantaneously, the actual response of the liquid crystal material is slow to respond. This may create an optical lag condition that may create visible bright and dark "flashes". For example, consider when the backlight brightness goes from low to high, the LCD transmissivity command goes from high to low value to maintain the same color/brightness to the viewer. Similarly, when the backlight brightness goes from high to low, the LCD transmissivity command goes from low to high value to maintain the same color/brightness to the viewer. However, the LCD transmissivity actual response may be slow, typically exhibiting a near logarithmic asymptotic approach to the new LCD transmissivity command value. The difference in the LCD transmissivity actual response and backlight brightness may create temporary color/brightness error that may be visible.

A logarithmic decay process takes a weighted average of the previous and the next value and replaces the previous value with the result. The simplest form of this is previous=(previous+next)/2 which will converge on a new value in a maximum of 8 steps when the difference between the previous and next is an 8-bit number. This is the "binary decay" formula because it moves half of the remaining distance at every step. A more general form is a weighted logarithmic decay: previous=(previous*(1−weight)+next*weight). If the weight value is one half, this is exactly the same as the previous formula. In an integer (hardware) environment the weight would be represented as a fixed point binary number. If the number of bits in the weight register is WBITS and WMUL=$2^{WBITS}$ then the formula would be:

```
previous=(previous*(WMUL−weight)+next*weight+
    round)/WMUL
```

where weight is a value from 1 to WMUL. Weight=WMUL/2 is the binary decay case. The above formula has several problems when implemented in integer arithmetic. If the round variable has the value of zero then the formula never converges on a constant next value that is higher than the previous value. If the round variable is WMUL−1 then the formula does not converge on a constant next value that is lower than the previous value. The solution is to set the round value based on the difference between the previous and next values:

```
if next > previous then
   round = WMUL−1
else
   round = 0
end
```

If this test is done beforehand, then the formula converges correctly in either direction.

Figure 11:
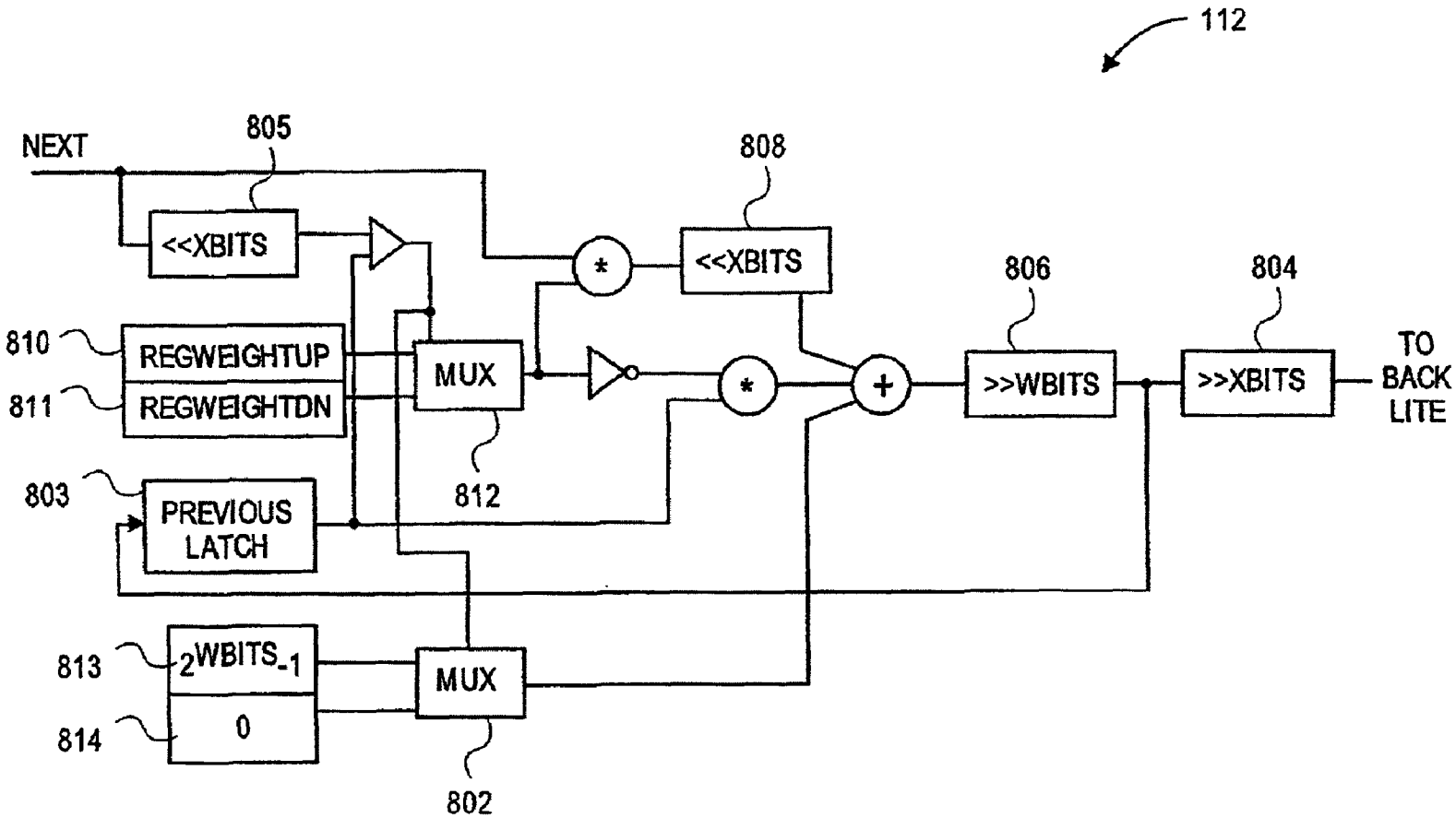
FIG. 11 is an embodiment of a decay delay module.

FIG. 11 depicts the Decay module 112. In FIG. 11, the comparator (having inputs form 805 and 803) compares the next value with the output from the previous latch 803 and selects WMUL−1 when next value is larger and zero when next value is smaller. Another problem with the above formula is it cannot step in fractions of an LED power level, so the slope of the decay can never become less than 1.0. The solution to this is to add extra bits to the previous value that are stored from frame to frame but never sent to the LED backlight. If the number of bits is XBITS and XMUL=2XBITS, then the formula becomes

```
previous=(previous*(WMUL−weight)+
    next*XMUL*weight+round)/WMUL where
    XMUL=2^XBITS.
```

Previous latch 803 may now be large enough to store the XBITS extra bits. Since the next value input does not have these bits, it may be modified by barrel shifter 805 before comparing it with the previous latch in the comparator. But the value output to the LED backlight controller is now:

```
previous>>XBITS
```

Next, an additional test to compare next>previous may be done, which may be done as (next<<XBITS)>previous now.

It is possible that increasing XBITS by one adds about 5 frame times to a response to a large change with a small weight. When weight=2 out of 15, XBITS=0, decaying from 0 to 127 takes around 26 frame times. If XBITS=4 then the decay takes 46 frame times.

There are many optimizations in the above formula. Dividing by WMUL is a right shift (at 806). The two multipliers may be (LEDBITS+XBITS)*WBITS in size, but since the lower bits of next*XMUL may be zero, this multiplier may only be (LEDBITS)*WBITS in size followed by a left shift. The value (WMUL−weight) can be calculated by inverting every bit in the weight value.

If gate count is an issue, the number of bits in the weight value can be reduced. This only decreases the number of different decay rates that we have to choose from. For example, if the weight value only has 4 bits, then there will be only 16 weight values to choose from, the round value will be set to 15 for converging up, and the multipliers would only have to multiply by 4 bit values and discard 4 bits afterwards. Note that this has no effect on the slope of the decay, only XBITS has an effect there.

Because LCD shutters converge to a new value at different rates when going up than when going down, it may be possible to have two separate registers to contain the decay rate for increasing separate from decreasing (e.g. 810 and 811). Since the round value is already being calculated based on the direction of the change, the weight value can be selected from two different registers based on the same test result.

Figure 12:
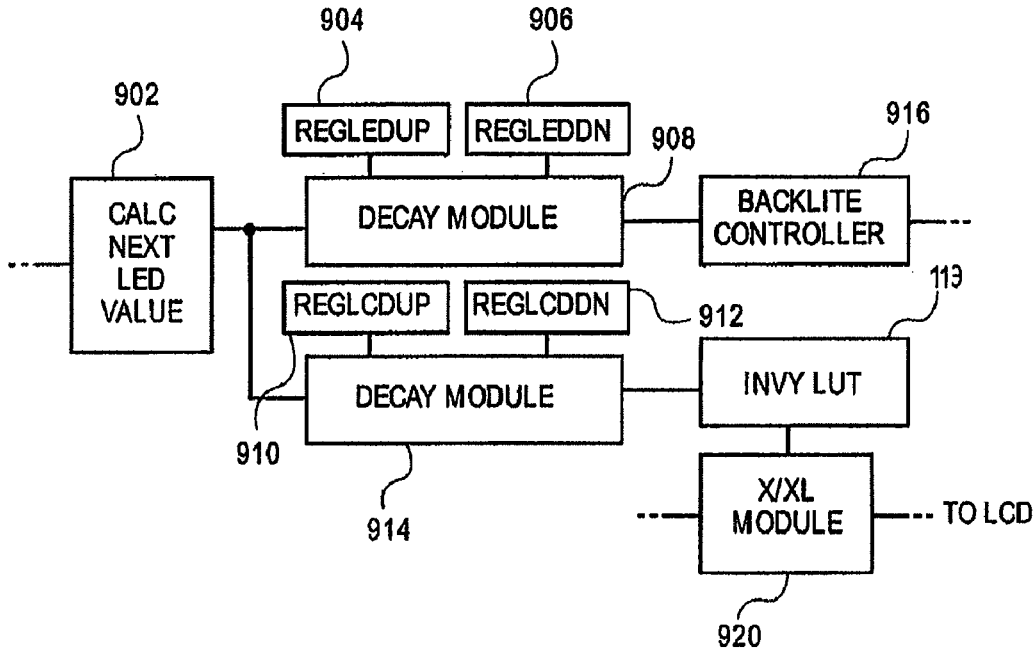
FIG. 12 is another embodiment of a decay delay module.

There may be a number of reasons for decaying any changes in the backlight value. One is to reduce flicker when the input image is changing rapidly. Another is to compensate for the slow response of LCD shutters when they are changed by large amounts. To implement both, FIG. 12 shows one possible embodiment of a Decay delay module 112 that contains two separate decay modules 908 and 914, each identical to the one described above. The LED power level is calculated in CALC module 902 and sent to both decay modules 908 and 914. Each decay module may have its own settable registers 904, 906 and 910, 912 respectively for the up and down decay. The output from one of the decay modules may go to Backlight Controller 916. The output from the second decay module, after being inverted by INV LUT 918, may go to the X/XL module 920 to effect the rest of the LCD path of the system. Note that both of the decay modules are decaying LED power values, which tend to have fewer bits than the INVy LUT values described above or the values in the gamma pipeline. It is possible to invert the output of the second decay module for use in the X/XL module 920.

X/XL may act as a normalization function. For example, for a RGB to RGBW display system, input image RGB data is first modified by the relationship between the brightness of each incoming RGB value after input gamma function and the actual amount of RGB light available at that given pixel from backlight array, as provided by a backlight interpolation function. This modification is accomplished in the X/XL module 920 by the ratio X/XL where X is the incoming value of R, G, or B. and XL is the backlight brightness value at that pixel of RL, GL, or BL. Thus, a given RGB to RGBW gamut mapping algorithm may have the input value R/RL, G/GL, B/BL.

Despite all the flexibility of this design, it still may be desirable to have different decay rates for different applications. For example, a slide show may require a rapid decay rate while a movie requires a slow decay rate. The decay rate could be changed if the system is informed what the display is being used for but this information is not always communicated.

Figure 13:
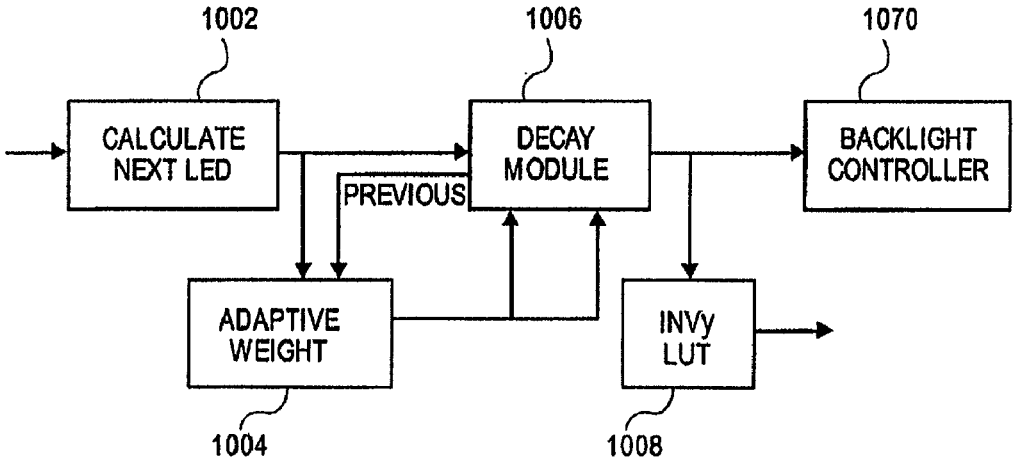
FIG. 13 is yet another embodiment of a decay delay module.
Figure 14:
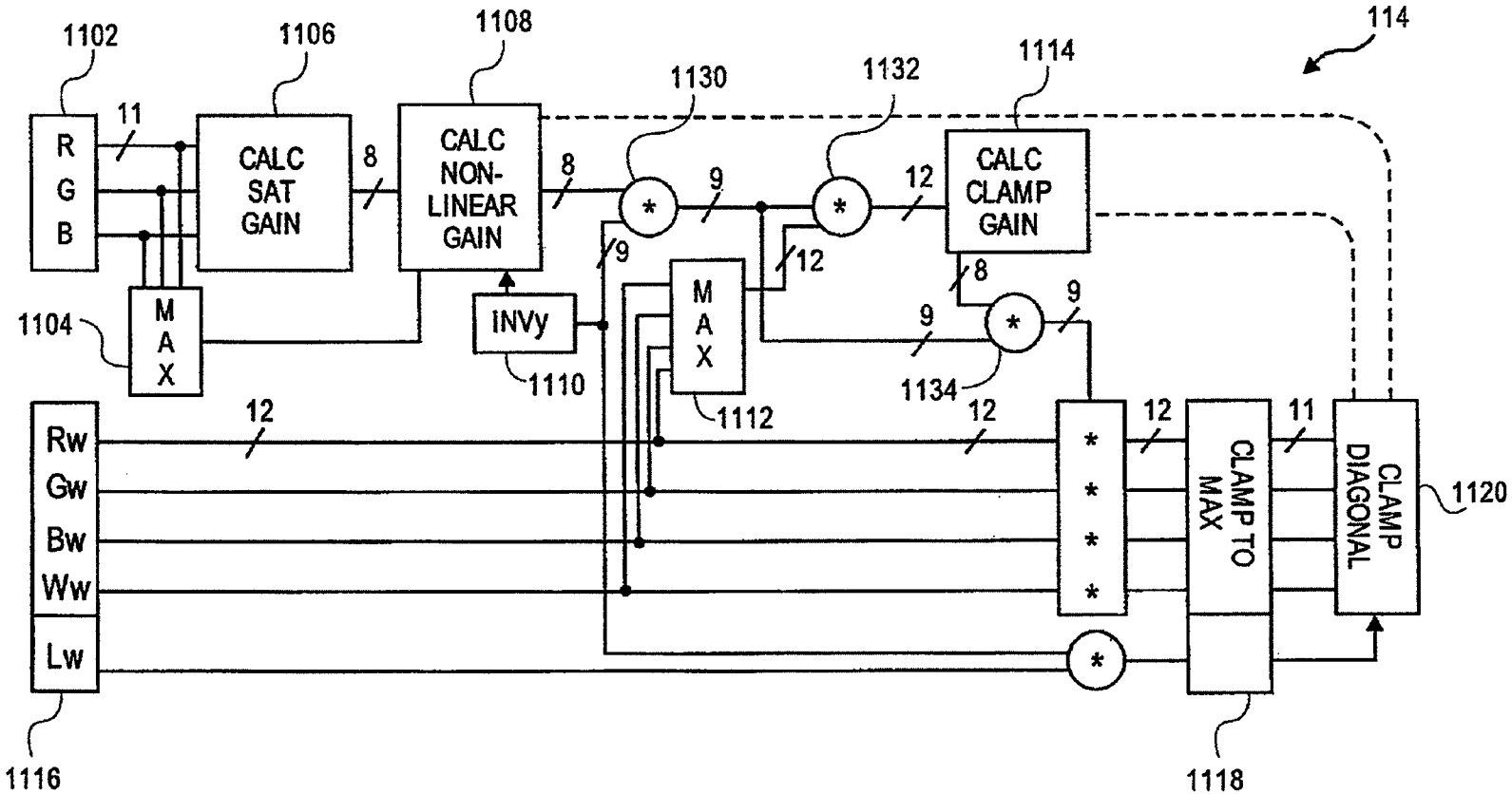
FIG. 14 is an embodiment of a post-scaler.

FIG. 13 depicts an alternative embodiment of the Decay module 112 that uses an adaptive transition rate. Adaptive weights may be calculated in 1004. The transition rate is calculated from the difference between the backlight of the previous and next LCD power rates.

```
weight=math·floor(math·abs(next−previous/XMUL)/
    (2^(LEDBITS−WBITS)))+1
```

The weight calculation above may take the absolute value of the difference between the previous and next LED value. It may be possible to use just the upper bits of the result. One may be added so that a zero weight may not be chosen which might prevent convergence on a new LED setting. The resulting weight is currently used for the up/down weights on both the LED and LED decay modules. This may greatly decrease the number of gates in the whole delay/decay module and simplifies it to the architecture of FIG. 13.

FIG. 13 depicts the Inv BL module 113. Once the LED power has the decayed value, it may be inverted to create a multiplier for the X/XL module 920. This may be done in an inverse LUT calculated beforehand. Since the first quarter of the values may be fixed values, some savings of hardware may be realized by doing them as a special case and making the LUT smaller. When the LED power is zero, the inverse value may be zero. For the quarter power values, the inverse value may be:

$$INVy=\text{math}\cdot\text{floor}(LEDMAX*INVMUL/((LEDquart+1)*2))$$

When LEDMAX=255, INVMUL=256 and LEDquart=63 then INVy=510 (although 511 is also reasonable). For the rest of the inverse table the values may be:

$$OverXL[LEDy]=\text{math}\cdot\text{floor}(LEDMAX*INVMUL/(LEDy*2))$$

where LEDy is the LED power level, typically between 64 and 255. It may be noticed that these are values between 510 and 128. The upper bit may always be on and this could allow a decrease in the size of the table.

Backlight illumination signals from Inv BL block 113 are then employed to drive the backlight of the display device. The backlight may be any one of many different types of backlights available—e.g. LED backlights, CCFL backlights or the like. The backlight could also be constructed in any known configuration—e.g. a 2-D array of individual emitters or a set of edge lit emitters or any other known configuration.

Post-Scaler

Post Scaler 114 provides post color conversion processing. In some embodiments, it is possible to incorporate modules that involve scaling the values by different amounts. For example, a saturation-based scaler may scale the saturated colors down to keep them in gamut. The X/XL module in a DBLC design scales the pixel values up or down by a value related to the backlight intensity. A GMA often incorporates a gamut damper module that scales the out-of-gamut colors down. Each of these modules may multiply the 3 or 4 pixel primary values by a scale factor. The pixel values are typically fairly large, 11 or 12 bits wide. The scale factors are typically a little smaller at 8 or 9 bits. In a display that has a separate pre-scaler, an X/XL module and a gamut clamper, each of these steps may use many gates to implement the multipliers.

The present Post Scaler may replace all of these large multipliers by one set at the end. The scale factors are combined into a single scale factor and only one large multiplier per primary is needed in the post scaler. Combining the scale factors together may also require multipliers, but these may be smaller 8×8 bit multipliers and these calculations are only done once per pixel instead of once per primary in every pixel. Also, optimizations can remove some of these scale factor multiplies and replace them with simple comparisons.

There are various embodiments of the Post Scaler with some optimizations that allow replacing some of the multipliers with simple minimum functions. These optimizations may work, for example, for bright images that were being scaled down. For very aggressive modes and dark images that are scaled up during X/XL, other different optimizations may be possible.

Clamping

"Clamping" refers to a technique of forcing a value that is out of gamut back into an acceptable range. If, after Scaling, a value is still out of gamut, then the value is clipped to ensure that all final values are within gamut. Clamping is done carefully to cause minimum change to the hue, and the techniques for clamping are described in previously filed patent applications.

Sub-Pixel Rendering (SPR)

After clamping, processing may optionally proceed with SPR. In one embodiment, it is possible to employ metamer-luminance sharpening. In another embodiment, it is possible to use mixed-saturation-sharpening in the display system. In mixed-saturation-sharpening, two sharpening filters may be used. When a pixel is near a saturated value, self-color-sharpening may be used. When a pixel is not near a saturated pixel, then metamer-luminance sharpening may be used. A saturation threshold bit calculated in the Calc Sat module may be used to determine if a pixel is saturated. To determine if a pixel is near a saturated one, the sat threshold bit may be stored in the SPR line buffers so that the surrounding orthogonal saturation values may be ORed with the saturation bit of the pixel. If the OR of these 5 bits is 1 then the pixel is near a saturated color. It is possible to store the sat threshold bit in the lower bit of the blue values in the SPR line buffers to conserve gates.

Output Gamma Dither/Output Quantizer Module

Image data may be processed in an optional Dither block 118 before the signals are sent to display—e.g. to drive individual subpixels upon display. During the output gamma process, pixel data are converted from the linear domain back to the non-linear domain (where the human vision system operates) using the output gamma function.

It may be desirable to have an LCD with a gamma of 1.0 so that the output gamma module may be greatly simplified. Instead of output gamma tables or gamma generators, the lower bits of the output values may be truncated or used for a final dither. In the example of an 11 bit pipeline, it is possible to truncate one bit, leaving 10 bits and use the next two bits for dithering an 8-bit result. This may use dither patterns that are better matched to particular repeating subpixel groupings that comprise the display. It is also possible to develop a three bit dither pattern and use all three of the lower bits for dithering.

In other embodiments, it is possible to use a dither table that has a separate bit for each sub pixel. In some tables, it is possible that both bits in each "logical pixel" may be on or off together. Thus, it may be possible that the table may be reduced to half the size by storing only one bit per logical pixel, or only one bit for every two subpixels. This may make the hardware easier to implement.

Figure 15:
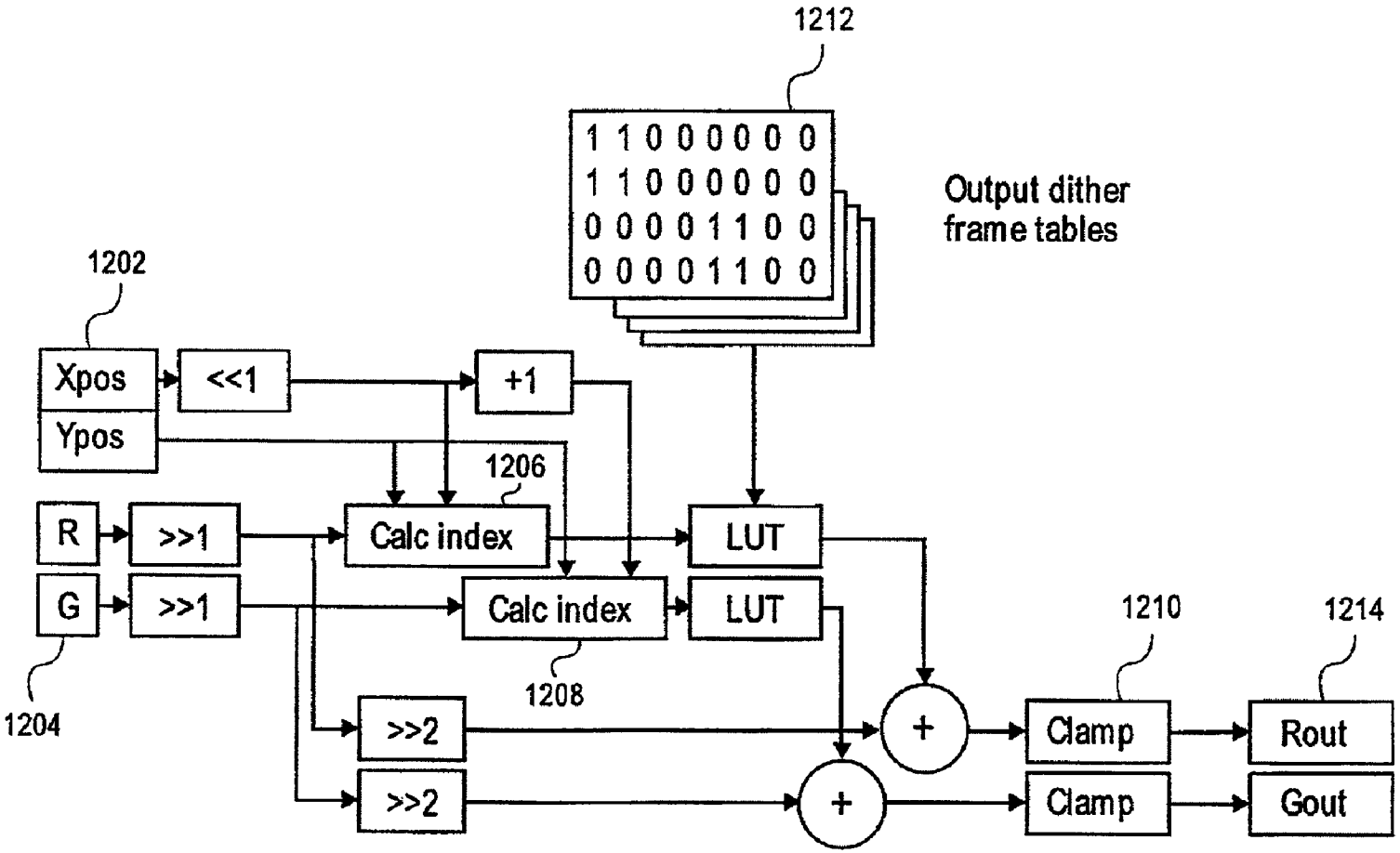
FIG. 15 is an embodiment of an output gamma dithering module.

Processing for an RG subpixel pair is shown in FIG. 15. The processing for BG may proceed likewise. The calculation for the index is just packing the lower bit of the logical pixel position (Xpos, Ypos) at 1202, an extra 0 or 1 bit for the R and G position, and two of the bits from either R or G. The R and G values may be ultimately shifted right by 3 converting an 11 bit value into an 8bit value. The adders may have a bypass mode to disable dithering. The adders (or alternatively, incrementers) may occasionally cause an integer overflow and this may be detected and clamped to the maximum output value. The order of operations is not imperative—the shifts could be done by simply selecting and packing all the right bits together.

Although systems and methods of dynamic backlight control in a display system have been described with reference to the specific embodiments, they are not limited thereto. For example, it will be appreciated that any other known data structure may be suitable for the purposes of controlling the backlight and light valve system and that the scope of the present invention should not be so limited to a histogram or the particular form and use of the histogram as presently discussed. Therefore, it will be readily understood by those skilled in the art that various modifications and changes can be made thereto without departing from the spirit and scope of the present invention defined by the appended claims.

What is claimed is:

1. A method of selecting an illumination level for a backlight in a display system, the method comprising:

determining a first value, wherein the first value is the highest illumination level requested by a pixel in a frame;

determining a second value for the frame, wherein the second value is calculated by:

dividing possible illumination levels into a predetermined number of bins, each of the bins covering a range of illumination levels;

determining an error function for at least the bin covering the highest range of illumination levels, wherein the error function correlates with luminance error introduced by selecting an illumination level of a neighboring bin covering a lower range of illumination levels;

identifying a critical bin of the bins, wherein the critical bin has an error function exceeding a threshold number and has the highest range of illumination levels out of the bins having error functions exceeding the threshold number; and calculating the second value based on the illumination level of the critical bin;

selecting a lower value between the first and second values.

2. The method of claim 1, further comprising determining a local peak value of a bin based on number of pixels in the frame requesting a particular illumination level in the range of illumination levels covered by the single bin.

3. The method of claim 2, wherein selecting a lower value between the first and second values comprises selecting a lower value between the first value and the local peak value of the critical bin.

4. The method of claim 1, further comprising determining an average illumination value for a bin based on illumination levels requested by pixels in the bin.

5. The method of claim 4, wherein selecting a lower value between the first and second values is selecting a lower value between the first value and the average illumination value of the critical bin.

6. The method of claim 1, wherein determining the error function comprises counting the number of pixels requesting an illumination level that falls in the range covered by at least one of the bins.

7. The method of claim 6, wherein the number of pixels requesting an illumination level that falls in one of the bins is counted up to a predetermined cap number.

8. The method of claim 6, wherein the illumination level requested by a pixel is determined using max (R, G, B, W) in a multiprimary display system.

9. The method of claim 1, wherein calculating the second value further comprises selecting a particular illumination level out of the range of illumination levels covered by the critical bin.

10. The method of claim 9, wherein the bins are arranged in a histogram and selecting the particular illumination level comprises:

identifying a first point defined as an intersection of the lowest illumination level covered by the critical bin and the cumulative error function (E_sum[i]) in the critical bin;

identifying a second point defined as an intersection of the lowest illumination level covered by an adjacent bin and the cumulative error function (E_sum[i+1]) of the adjacent bin, the adjacent bin covering the next highest range of illumination levels compared to the critical bin;

drawing a straight line through the first point and the second point;

identifying a third point defined as an intersection of the straight line and the threshold number; and determining the particular illumination level based on the third point.

11. The method of claim 9, wherein the bins are arranged in a histogram and selecting the particular illumination level comprises:

identifying a first point defined as an intersection of the lowest illumination level covered by the critical bin and the cumulative error function (E_sum[i]) in the critical bin;

identifying a second point defined as an intersection of the highest illumination level covered by the critical bin and a second threshold number, the second threshold number being higher than the first threshold number;

drawing a straight line through the first point and the second point;

identifying a third point defined as an intersection of the straight line and the cumulative error function of the critical bin (E_sum[i]); and determining the particular illumination level based on the third point.

12. The method of claim 1, wherein dividing possible illumination levels into a predetermined number of bins includes using digital illumination values to define the bins.

13. A display system comprising:

a display for displaying images;

a backlight for illuminating said display, said backlight comprising a set of illumination levels; and a backlight level selection module including:

a block for determining a first value, wherein the first value is the highest illumination level requested by a pixel in a frame;

a block for dividing possible illumination levels into a predetermined number of bins, each of the bins covering a range of illumination levels;

a block for determining an error function for at least the bin covering the highest range of illumination levels, wherein the error function correlates with luminance error introduced by selecting an illumination level of a neighboring bin covering a lower range of illumination levels;

a block for identifying a critical bin of the bins, wherein the critical bin has an error function exceeding a threshold number and has the highest range of illumination levels out of the bins having error functions exceeding the threshold number; and a block for calculating a second value based on the illumination level of the critical bin; and a block for selecting a lower value between the first and second values.

14. The display system of claim 13, wherein the backlight level selection module further includes a block for determining a local peak value of a bin based on number of pixels in the frame requesting a particular illumination level in the range of illumination levels covered by the single bin.

15. The display system of claim 14, wherein the block for selecting a lower value between the first and second values comprises a block for selecting a lower value between the first value and the local peak value of the critical bin.

16. The display system of claim 13 further comprising a block for determining an average illumination value for a bin based on illumination levels requested by pixels in the bin.

17. The display system of claim 16, wherein the block for selecting a lower value between the first and second values comprises a block for selecting a lower value between the first value and the average illumination value of the critical bin.

18. The display system of claim 13, wherein the block for determining the error function comprises a block for counting the number of pixels requesting an illumination level that falls in the range covered by at least one of the bins.

19. The display system of claim 18, wherein the block counting the number of pixels counts up to a predetermined cap number.

20. The display system of claim 18, wherein the illumination level requested by a pixel is determined using max (R, G, B, W) in a multiprimary display system.

21. The display system of claim 13, wherein the bins are arranged in a histogram and the block selecting the particular illumination level comprises:

a block identifying a first point defined as an intersection of the lowest illumination level covered by the critical bin and the cumulative error function (E_sum[i]) in the critical bin;

a block identifying a second point defined as an intersection of the lowest illumination level covered by an adjacent bin and the cumulative error function (E_sum[i+1]) of the adjacent bin, the adjacent bin covering the next highest range of illumination levels compared to the critical bin;

a block drawing a straight line through the first point and the second point;

a block identifying a third point defined as an intersection of the straight line and the threshold number; and a block determining the particular illumination level based on the third point.

22. The display system of claim 21, wherein the bins are arranged in a histogram and selecting the particular illumination level comprises:

a block identifying a first point defined as an intersection of the lowest illumination level covered by the critical bin and the cumulative error function (E_sum[i]) in the critical bin;

a block identifying a second point defined as an intersection of the highest illumination level covered by the critical bin and a second threshold number, the second threshold number being higher than the first threshold number;

a block drawing a straight line through the first point and the second point;

a block identifying a third point defined as an intersection of the straight line and the cumulative error function of the critical bin (E_sum[i]); and a block determining the particular illumination level based on the third point.

23. The display system of claim 13, wherein the block for dividing possible illumination levels into a predetermined number of bins includes using digital illumination values to define the bins.

* * * * *